United States Patent [19]

Saito et al.

[11] Patent Number: 4,478,046

[45] Date of Patent: Oct. 23, 1984

[54] CRYOGENIC REFRIGERATOR

[75] Inventors: Hidefumi Saito, Osaka; Munehiro Hayashi, Kyoto; Hisashi Mitani, Osaka; Hiromu Isaka; Masanao Andoh, both of Kyoto, all of Japan

[73] Assignee: Shimadzu Corporation, Kyoto, Japan

[21] Appl. No.: 486,307

[22] Filed: Apr. 19, 1983

[30] Foreign Application Priority Data

| | | | |
|---|---|---|---|
| Apr. 22, 1982 | [JP] | Japan | 57-68489 |
| Apr. 22, 1982 | [JP] | Japan | 57-68490 |
| Jan. 29, 1983 | [JP] | Japan | 58-13204 |

[51] Int. Cl.[3] ..... F25B 9/00

[52] U.S. Cl. ..... 62/6; 62/402

[58] Field of Search ..... 62/6, 402

[56] References Cited

U.S. PATENT DOCUMENTS

| | | | |
|---|---|---|---|
| 3,483,694 | 12/1969 | Huber et al. | 62/6 |
| 3,487,424 | 12/1969 | Leger | 62/6 |
| 3,488,945 | 1/1970 | Kelly | 62/6 |
| 3,492,818 | 2/1970 | Kelly | 62/6 |
| 3,516,245 | 6/1970 | Kelly | 62/6 |
| 3,535,872 | 10/1970 | Kelly | 62/6 |
| 3,537,256 | 11/1970 | Kelly | 62/6 |
| 3,537,269 | 11/1970 | Kelly | 62/6 |

*Primary Examiner*—Ronald C. Capossela

*Attorney, Agent, or Firm*—Fidelman, Wolffe & Waldron

[57] ABSTRACT

A cryogenic refrigerator of rotary type which comprises a generally cylindrical rotor and an expander formed about a first axial portion of the rotor which is used as the expander rotor, with a plurality of radial vanes for defining about the expander rotor a series of expansion compartments which vary in volume as the rotor rotates. A regenerator is provided inside or outside and about a second axial portion of the rotor adjacent to and in fluid communication with the expander compartments. A compressor supplies compressed gas to the expander compartments for adiabatic expansion accompanied by a temperature drop of the expanded gas, which is conducted through the regenerator back to the compressor. The compressor may be of a rotary type and formed about a third axial portion of the rotor adjacent to the regenerator, with the third rotor portion being used as the compressor rotor having a plurality of radial vanes for defining about the compressor rotor a series of compression compartments which, as the rotor rotates, vary in volume in a predetermined correlation to the variation of volume of the expansion compartments.

17 Claims, 11 Drawing Figures

COMPRESSOR
21
21b
21a
22
15
14
0
19
17
19
1c
1
13
18
16
II
II
8b
8b
1b
9
9
8
8
2a
III
III
10
9
10
9
3
S1
S1
8a
8a
IV
IV
11
7
4
4a
2
11
S2
1a
7
0

COMPRESSOR
21
21a
21b 0
1
22
14
15
68a
68
69
66b
70b
67
65
54a
2
70a
66b
67a
8b
8b
50
54
8
63
8
8a
8a
66a
66a
64
64
59
B3
B1
55c
58c
51
58
57c
55
56
56c
3
60
56
60
56d
57b
IX
62
57
IX
B4
53
55d
57d
55a
59
58d
0'
0
52
B2

CRYOGENIC REFRIGERATOR

BACKGROUND OF THE INVENTION

This invention relates to a cryogenic refrigerator of a rotary type suitable for use in the field of cryoelectronics.

There are known various types of cryogenic refrigerators which are based on Stirling, Solvay or Gifford-McMahon thermodynamic priciples for production of cryogenic temperatures. They are provided with a compressor and an expander with a regenerator interposed therebetween, and are so arranged that cyclin adiabatic expansion in the expander of the working gas such as helium compressed by the compressor causes a continuous temperature drop in the expander and the regenerator, thereby providing a cryogenic temperature.

In the majority of the known refrigerators of the above-mentioned type, the compressor and the expander are of a reciprocating piston type, that is, of the type that a piston is reciprocated within a cylinder for compression or expansion of the working gas.

The compressor or the expander of the reciprocating type, however, has the following disadvantages.

While the device is running, the reciprocating piston causes considerable mechanical vibration and noise to occur and due to low durability of the piston seal the device has a relatively short operation life. Also, in order to make the refrigerator compact in size and light in weight without appreciable reduction of the refrigerating capacity, it is necessary to increase the number of cycles per unit period of time. However, such increase in the number of cycles is accompanied by a corresponding increase in the accelaration of the reciprocating piston and its associated members, with a resulting increase in the load on the cam, crank and other members for controlling the motion of the piston. This means that if the compressor, the expander or the regenerator is to be made compact or small in size, for compensation of the decrease in the capacity by a higher speed of operation a greater mechanical strength is required of the movable members of the device, with a resulting increase in the size of the device. This certainly is a contradiction or dilemma and by using a compressor and/or an expander of the reciprocating piston type it is practically impossible to make the refrigerator compact in size without appreciable lowering of its performance. Moreover, a great acceleration acting on the piston or its associated members causes magnetic noise to occur so that the refrigerator becomes unsuitable for cooling cryoelectronic devices such as a SQUID.

The object of the invention is therefore to provide a cryogenic refrigerator of a rotary type which has completely eliminated the above-mentioned and other disadvantages of the prior art devices.

The invention will be described in detail with reference to the accompanying drawings.

SUMMARY OF THE INVENTION

Figure 1:
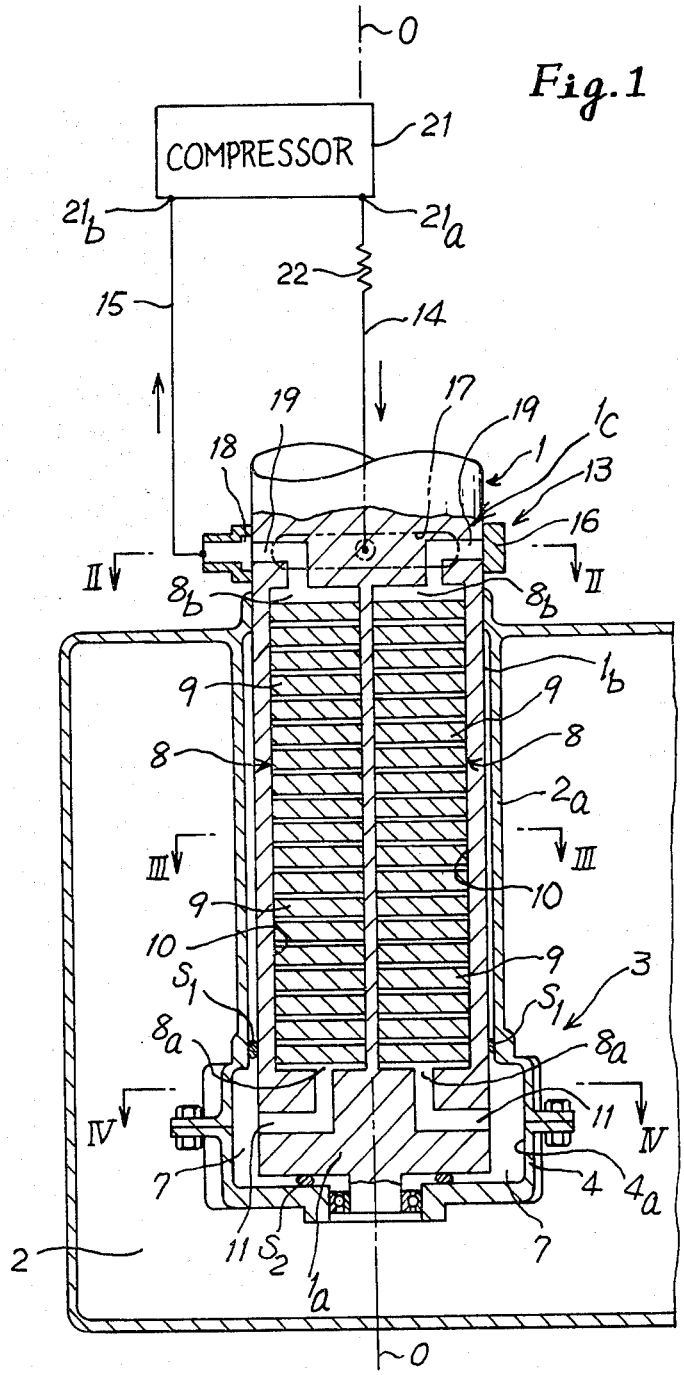
FIG. 1 is a vertical section of one embodiment of the invention.

Briefly stated, the refrigerator constructed in accordance with the invention comprises a generally cylindrical rotor, a compressor, an expander and a regenerator interposed therebetween. The expander is of a rotary type and comprises a casing defining an expander chamber about a first axial portion of the rotor and a plurality of vanes associated with the first rotor portion and the inner circumferential wall surface of the expander casing so as to divide the expander chamber into a plurality of expansion compartments which vary in volume and relative position within the expander casing as the rotor rotates.

The regenerator is associated with a second axial portion of the rotor adjacent to the first axial portion thereof and has a low-temperature and a high-temperature end, between which the working gas passes, and the low-temperature end is disposed adjacent to the expansion compartments of the expander for fluid communication between the regenerator and the expander.

The compressor supplies compressed gas to the expander through the regenerator so that as the rotor rotates, the compressed gas introduced successively into the expansion compartments undergoes adiabatic expansion accompanied by a temperature drop in the expanded gas, which is returned through the regenerator to the compressor for subsequent compression.

DESCRIPTION OF PREFERRED EMBODIMENTS

Referring now to FIGS. 1 to 4, there is shown a rotor generally designated by 1 and comprising an elongated generally cylindrical member rotatable about a longitudinal axis 0. The rotor 1 has a lower portion inserted in an adiabatic vacuum tank 2, with a cylindrical casing 2*a* projecting inwardly of the tank and surrounding the major part of the inserted lower portion of the rotor. Inside the tank 2, an expander 3 is formed with the lower end portion 1*a* of the rotor 1 used as an expander rotor.

The lower portion 4 of the casing 2*a* is used as the casing of the expander, in which an expansion chamber 7 is formed around the expander rotor 1*a* with seal rings $S_1$ and $S_2$ sealing the chamber 7 against adjacent spaces.

Figure 4:
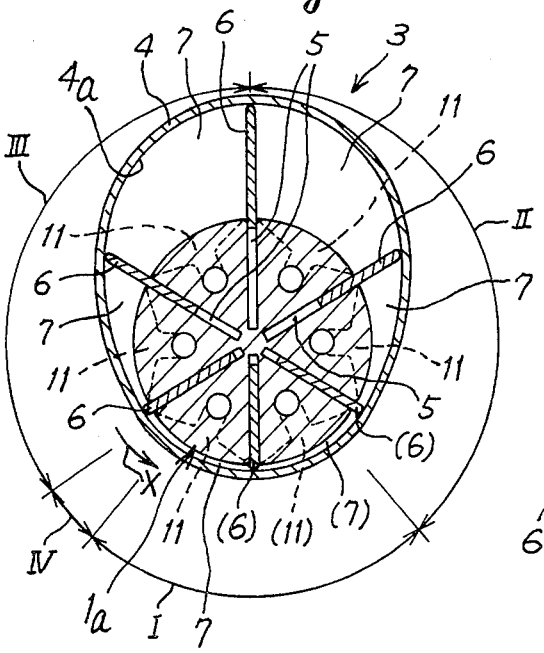
FIG. 4 is a transverse section taken along line IV—IV in FIG. 1.

As shown in FIG. 4, the expander rotor 1*a* is provided with a plurality, say, six radial slots 5 and a plurality, say, six vanes 6 each slidably inserted in one of the radial slots 5. The vanes 6 are biased radially outwardly by means of a spring not shown but disposed in each of the slots 5, or a pressure acting on the inner ends of the vanes, or a centrifugal force produces as the rotor 1 is rotated, so that the vanes 6 project out of the respective slots 5 as far as the outer edges thereof abut slidably on the inner circumferential wall surface 4*a* of the expander casing 4, thereby to define in the expansion chamber 7 a plurality, say, six separate compartments, also designated by 7, between each adjacent two of the vanes. The inner circumferential wall surface 4*a* of the expander casing 4 is formed into a particular shape in transverse section as shown in FIG. 4.

As the rotor 1*a* is rotated counterclockwise as shown by an arrow X in FIG. 4, the expansion chamber compartments 7 are simultaneously moved in the same direction with their respective volumes varying in the following manner.

While the compartments 7 are passing the first and second areas I and II of the expansion chamber in the counterclockwise direction X in FIG. 4, they gradually increase in volume, whereas while they are passing the third area III, they gradually decrease in volume.

Inside the middle portion 1*b* of the cylindrical rotor 1 there is provided a regenerator 8 above and adjacent the expander rotor 1*a*. In the illustrated embodiment the regenerator 8 comprises six units, also designated by 8, each consisting of, for example, a plurality of perforated sector-shaped copper plates 9 piled one upon another with a suitable spacer plate of a similar shape interposed therebetween, and the six regenerator units 8 are arranged in six longitudinal cavities 10 formed in the rotor portion 1*b* and having a sector-shaped transverse section corresponding to the sector shape of the copper plates.

The low-temperature ends 8*a* of the regenerator units 8 communicate with the expansion chamber compartments 7 through a plurality, say, six inlet-outlet ports or passages 11 as shown in FIG. 4. The opposite high-temperature ends 8*b* of the regenerator units 8 communicate through a switching valve mechanism 13 selectively with a supply pipe 14 or a discharge pipe 15 both schematically shown as a simple line.

Figure 2:
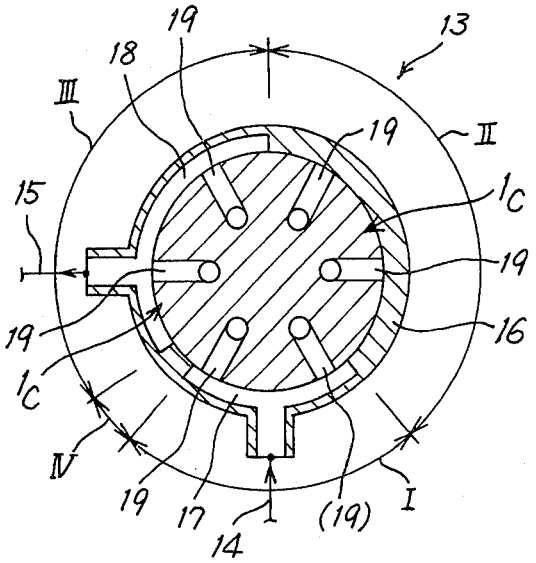
FIG. 2 is a transverse section taken along line II—II in FIG. 1.
Figure 3:
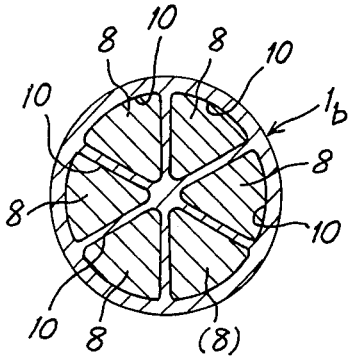
FIG. 3 is a transverse section taken along line III—III in FIG. 1.

As shown in FIGS. 1 and 2, the valve mechanism 13 comprises a fixed ring 16 so arranged as to surround an upper portion 1*c* of the cylindrical rotor 1 outside the adiabatic vacuum tank 2 in slidable sealing relation to the outer circumferential surface of the rotor portion 1*c*. As shown in FIG. 2, the ring 16 is formed with an arcuate inlet port 17 connected to the above-mentioned supply pipe 14 and an arcuate outlet port 18 spaced a suitable circumferential distance from the inlet port 17 and connected to the above-mentioned discharge pipe 15.

In the rotor portion 1*c* slidably covered by the fixed ring 16 there are formed a plurality, say , six radially extending inlet-outlet ports 19 spaced an equal angular distance apart from each other as shown in FIG. 2. Each of the six ports 19 communicates with one of the six cavities 10 in the regenerator units 8 at the high-temperature ends 8*b* thereof as shown in FIG. 1.

The inlet and outlet ports 17 and 18 arcuately extend a predetermined length in the circumferential direction of the rotor and are so arranged that while each of the expander compartments 7 is passing the previously mentioned first area I upon rotation of the cylindrical rotor 1 in the previously mentioned direction X, the corresponding port 19 communicates with the inlet port 17 of the valve 13, and while each of the expander compartments 7 is passing the third area III, the corresponding port 19 communicates with the outlet port 18 of the valve 13 (FIGS. 2 and 4).

The supply line 14 supplies to the inlet port 17 of the timing valve 13 the compressed gas from the discharge port 21*a* of a compressor 21 through an air-cooled cooler 22, both schematically shown in FIG. 1, while the discharge line 15 returns the expanded gas from the outlet port 18 of the valve 13 into the compressor 21 through its inlet port 21*b*.

The refrigerator shown in FIGS. 1 to 4 operates in the following manner. In the illustrated embodiment of the invention, the refrigerator is provided with six expansion compartments 7 and the same number of various associated devices and members, such as six generator units 8. However, since the six groups operate in the same manner, the operation of only one of them will be explained with the component members being designated by their respective reference numerals in parenthesis ( ). In the following description, the expression that the expansion compartment (7) "exists or is present in the area I, II, III or IV" or other similar expression mean that "that portion of the compartment (7) which corresponds to or communicates with the inlet-outlet port (19) exits or is present in the area I, II, III or IV."

While the compartment (7) exits in the first area I, the inlet-outlet port (19) which communicates with that compartment (7) communicates with the supply port 17 of the valve 13, so that the high-pressure gas discharged from the compressor 21 is supplied through the supply pipe 14 into the inlet port (19) so as to be introduced into the compartment (7) through the corresponding regenerator unit (8). The leading vane (6) at the forward side in the direction X of rotation of the rotor 1*a* has a larger pressure-receiving surface area than the trailing vane (6) at the rear side in the rotational direction X, so that the high-pressure gas introduced into the compartment (7) through the corresponding regenerator unit (8) causes the expander rotor 1*a* to rotate in the same direction X together with the compartment (7).

As the compartment (7) is moved into the area II, the inlet port (19) is closed by the inner circumferential wall of the fixed ring 16, whereupon the supply of high-pressure gas into the port (19) is terminated. However, the high pressure of the compressed gas in the compartment (7) is yet maintained at this stage and the leading vane (6) has a larger pressure-receiving area than the trailing vane (6), so that the compressed gas in the compartment (7) expands as it drives the rotor 1 in the direction X. In this manner, while the compartment (7) is passing the area II, the gas therein expands adiabatically so that its temperature drops. The rotational force of the rotor 1 can be utilized by connecting to the rotor 1 a suitable rotary machine (not shown) such as an electric generator.

As the compartment (7) is farther moved into the third area III, inlet port 19 comes into communication with the discharge port 18 of the valve 13, so that the port 19 now functions as an outlet port, whereupon as the rotor 1 farther rotates in the counterclockwise direction X, the compartment (7) now existing in the area II begins to decrease gradually in volume due to the particular shape of the corresponding portion of the inner cylindrical surface 4*a* of the expander casing 4, so that the expanded low-temperature gas is pushed out of the compartment (7) and conducted through the corresponding regenerator unit (8) while cooling the same and then through the port (19) out into the outlet port 18, from which the gas is returned into the compressor 21 through the discharge line 15.

The compartment (7) from inside which substantially all of the expanded gas has been removed now comes into the fourth area IV, where the port (19) is again closed, whereupon one cycle of operation has been completed.

When, upon further rotation of the rotor 1, the compartment (7) again comes into the first area I, the next cycle of operation is started. By repeating the above cycle of operation a number of times it is possible to lower the temperature of the expander casing 4 to a cryogenic level, thereby to continuously cool a thermal load not shown by disposed adjacent the casing 4.

Figure 5:
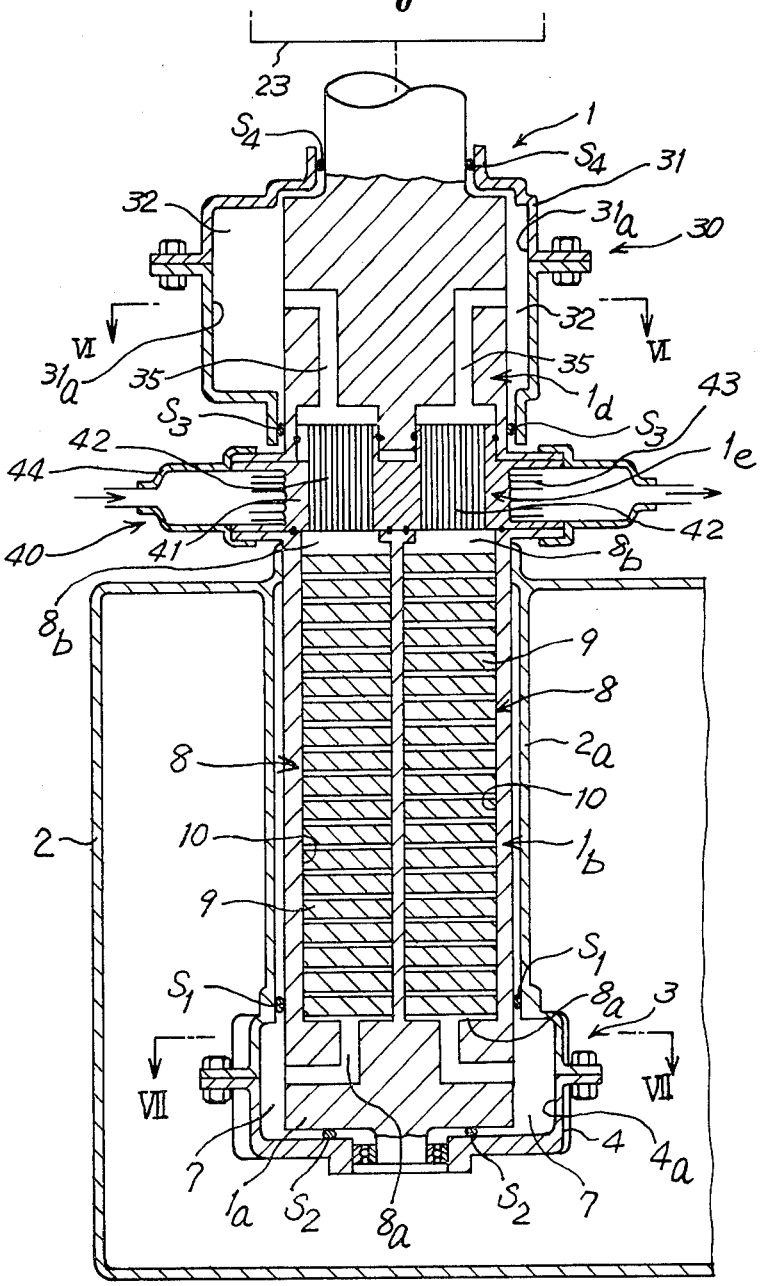
FIG. 5 is a view similar to FIG. 1 but showing a second embodiment of the invention.
Figure 6:
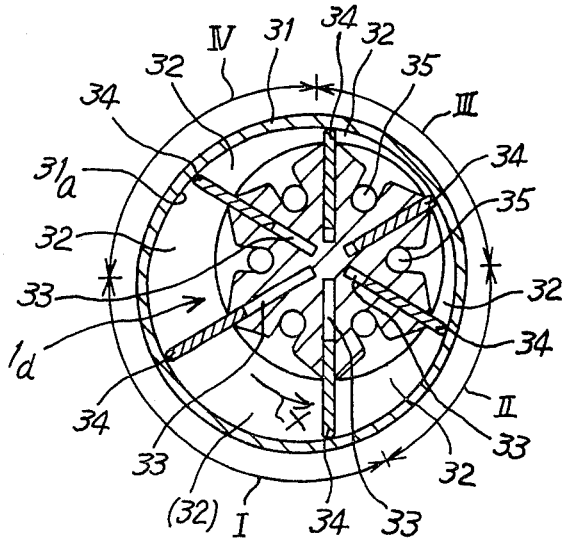
FIG. 6 is a transverse section taken along line VI—VI in FIG. 5.
Figure 7:
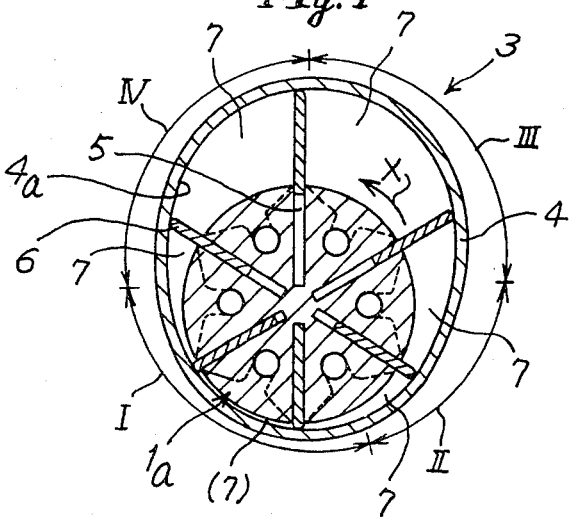
FIG. 7 is a transverse section taken along line VII—VII in FIG. 5.

Another embodiment of the invention is shown in FIGS. 5 to 7, wherein the same reference numerals as in FIGS. 1 to 4 designate corresponding component parts, so that no explanation will be given to them except when necessary.

In this embodiment of the invention, the refrigerator is provided with a compressor of a rotary type generally designated by 30.

The cylindrical rotor 1 has outside the vacuum tank 2 a portion 1*d* surrounded by a casing 31, which defines a compression chamber 32 about the circumferential surface of the rotor portion 1*d*, with seal rings S3 and S4 sealing the chamber 32 against a surrounding atmosphere. As shown in FIG. 6 the rotor portion 1*d* is provided with a plurality, say, six radial slots 33 and a plurality, say, six vanes 34 each slidably inserted in one of the radial slots 33. For simplicity of illustration the slots 33 and the vanes 34 are not shown in FIG. 5. Upon rotation of the rotor 1, a centrifugal force produced causes the vanes 34 to project outwardly of the respective slots 33 as far as the outer edges thereof abut slidably on the inner circumferential surface 31*a* of the casing 31 thereby to define in the compression chamber 32 six separate compartments, also designated by 32, between each adjacent two of the vanes 34.

The inner circumferential wall surface 31*a* of the compressor casing 31 is formed into a particular shape in transverse section as shown in FIG. 6.

As the rotor 1 is rotated counterclockwise as shown by an arrow X, the compression compartments 32 are moved in the same direction, varying in volume in the following manner.

While the compartments 32 are passing the first and second areas I and II in the direction X in FIG. 6, the compartments 32 gradually decrease in volume; and while they are passing the third area III, their volume remains nearly zero; and while they are passing the fourth area IV, they gradually increase in volume.

As previously mentioned, the expander 3 in this embodiment is substantially the same in construction as in the previous embodiment, with the component parts being designated by the same reference numerals. As shown in FIG. 7, while the expansion chamber compartments 7 are passing the first area I, their volume is kept nearly zero; and while the compartments are passing the second and third areas II and III in the direction X, they gradually increase in volume; and while they are passing the fourth area IV, they gradually decrease in volume. The compressor and the expander are correlatively so arranged that while each of the compression chamber compartments 32 and the corresponding one of the expansion chamber compartments 7 are passing the second area II and also the fourth area IV, the two correlated compression and expansion compartments 32 and 7 change in volume at such a rate that the sum of the volumes of the two compartments is kept constant.

In the second embodiment of the invention, the high-temperature end 8*b* of each of the regenerator units 8 is connected through a cooler 40 and a passage 35 to the corresponding one of the compression compartments 32.

The cooler 40 comprises a heat-exchanging block 41 which constitutes a portion 1*e* of the cylindrical rotor 1. A plurality of groups of gas dispersing passages 42 are formed in the heat-exchanging block 41 so that each of the groups of passages 42 connects one of the regenerator units 8 to the corresponding one of the previously mentioned passages 35 in the compressor rotor 1*d* and thence to the corresponding one of the compression compartments 32.

The heat-exchanging block 41 is provided with a plurality of heat-radiating fins 43 projecting outwardly from the outer circumferential surface thereof. A water jacket 44 rotatable relative to the block 41 covers the fins 43 and defines about the heat-exchanging block 41 a surrounding space, through which cooling water flows to cool the gas passing through the block 41 and the adjacent portion of the compression chamber 32.

The device shown in FIGS. 5 to 7 operates in the following manner. Since all the six compression compartments 32 and all the corresponding six expansion compartments 7 with their associated parts and members operate in the same way, only one of the compression compartments and the corresponding one of the expansion compartments with the associated parts or members will be taken for example, with their respective reference numerals given in parenthesis.

As the rotor 1 is rotated by a suitable drive schematically shown at 23 in FIG. 5 in the counterclockwise direction X in FIGS. 6 and 7, the compression compartment (32) and the corresponding expansion compartment (7) in the first area I are moved in the same direction, so that the volume of the former compartment (32) decreases to compress the gas therein, while that of the latter compartment (7) remains approximately zero. As the two compartments (32) and (7) move onto the second area II, the compression compartment (32) further decreases in volume and the expansion compartment (7) increases in volume, both at such rates that the sum of the volumes of the two compartments remains unchanged, so that the compressed gas in the compression compartment (32) flows into the expansion compartment (7) through the cooler 40 and the regenerator 8 without undergoing any substantial change in volume. While the compressed gas flows through the cooler 40, it is cooled down to the temperature of the cooling water and while the gas flows through the regenerator 8 it is further cooled down.

Then while the compartments (32) and (7) move in the third area III, the volume of the compression compartment (32) is kept substantially zero, whereas that of the expansion compartment (7) gradually increases, so that the gas in the compartment (7) expands adiabatically, with resulting lowering of the temperature of the gas and that of the expander casing 4.

Then as the two compartments (32) and (7) move into and through the fourth area IV, the compression compartment (32) gradually increases in volume and the expansion compartment (7) gradually decreases in volume, both at such rates that the total volume of the two compartments remains unchanged, so that the expanded low-temperature gas in the expansion compartment (7) is transferred back to the compression compartment (32) without causing any substantial change in the volume of the gas. In the course of transfer, the gas cools the regenerator 8. Thus one cycle of operation is completed.

Upon further continuous rotation of the cylindrical rotor 1, the compartments (32) and (7) again move into the first area I for the next cycle of operation.

After a number of cycles of operation the temperature of the casing 4 of the expander 3 is lowered to a very low level so as to enable continuous cooling of a thermal load adjacent the casing 4.

Figure 8:
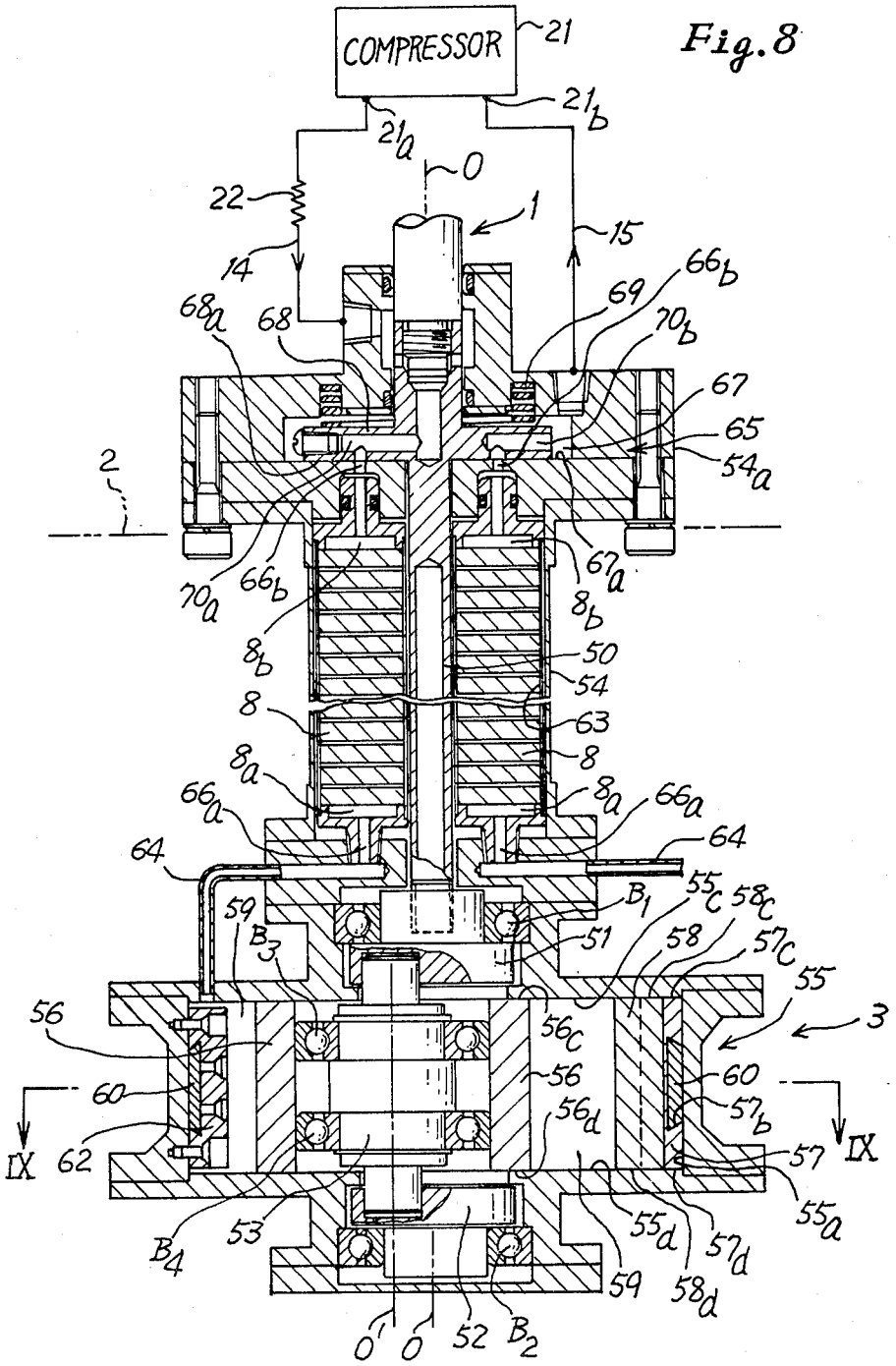
FIG. 8 is a view similar to FIG. 1 but showing a third embodiment of the invention.
Figure 9:
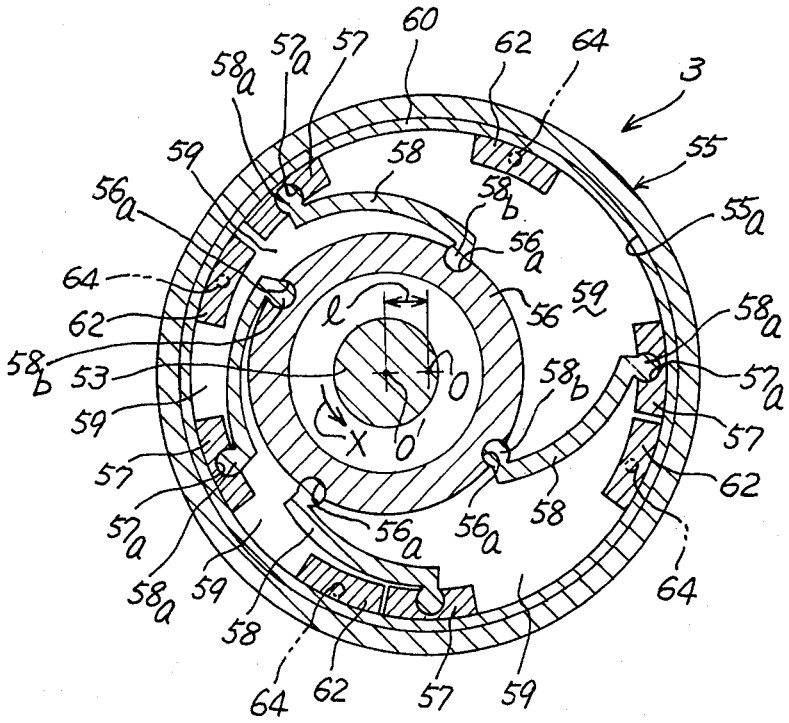
FIG. 9 is a transverse taken along line IX—IX in FIG. 8.
Figure 10:
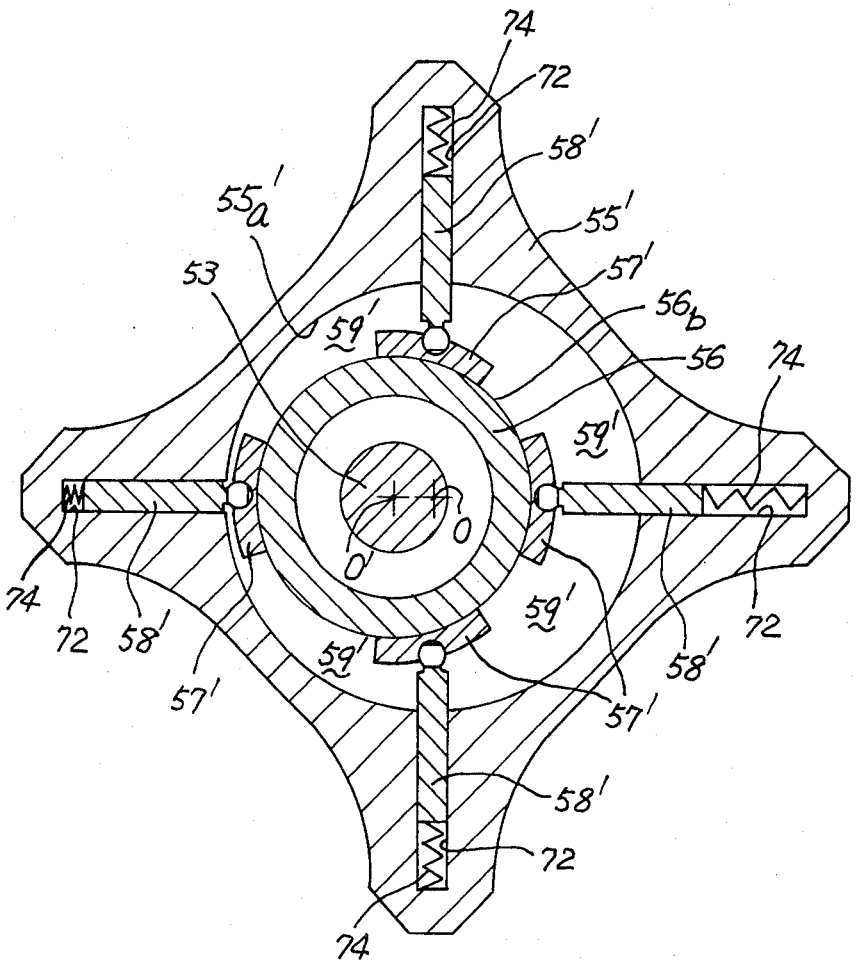
FIG. 10 is a view similar to FIG. 9 but showing a different form of the expander.

A third embodiment of the invention is shown in FIGS. 8 to 10, wherein the same reference symbols as in the previous embodiments designate corresponding parts so that no explanation of these parts will be given except when necessary.

In this third embodiment, the rotor 1 comprises a shaft 50 rotatable about a longitudinal axis 0, a first or upper rotatable disk 51, a second or lower rotatable disk 52, and an eccentric shaft 53 interposed between the two disks 51 and 52.

A casing 54 is attached to an adiabatic vacuum tank 2 so that the major lower portion of the casing 54 is positioned inside the tank 2. The shaft 50 has its upper end connected to a suitable machine, such as a generator (not shown) in a normal (room) temperature area outside the casing 54 and extends downwardly into the casing 54. The upper rotatable disk 51 is secured to the lower end of the shaft 50 and supported by the inner circumferential surface of the casing 54 through a ball bearing B1 for simultaneous rotation with the shaft 50 about the same axis 0. The lower rotatable disk 52 is supported by the inner circumferential surface of the lower end of the casing 54 through a ball bearing B2 for rotation about the same axis 0 as the shaft 50. The eccentric shaft 53 has its upper and lower end secured to the upper and lower disks 51 and 52, respectively, for rotation about the axis 0, with its own axis 0' being eccentric a predetermined distance 1 with respect to, and parallel with, the axis 0 of the shaft 50.

The casing 54 has its lower end portion enlarged in diameter to provide a casing 55 for the expander 3. The expander comprises a rotor 56 in the form of a short hollow cylindrical body or ring supported by the eccentric shaft 53 through a pair of bearings B3 and B4 for rotation about the axis 0' of the eccentric shaft 53; a plurality, say, four slides 57 slidably supported by the inner circumferential surface 55*a* of the expander casing 55; and a plurality, say, four curved vanes 58 having their respective opposite lateral edges hinged to the slides 57 and the outer circumferential surface of the expander rotor 56 at circumferentially spaced apart positions, thereby to divide the expansion chamber 59 into a plurality, say, four compartments of varying volume, also designated by 59.

In particular, each of the vanes 58 is slightly curved as shown in FIG. 9 and is formed along the opposite lateral edges with a bead 58*a*, 58*b* extending perpendicularly to the plane of the paper of the drawing figure, and each of the slides 57 is formed on the inner surface facing the expander rotor 56 with a corresponding groove 57*a* extending perpendicularly to the plane of the drawing paper.

Four grooves 56*a* similar to the above-mentioned grooves 57*a* are formed in the outer circumferential surface of the expander rotor 56 at four positions 90° apart from each other.

Each of the vanes 58 has its lateral beads 58*a* freely but captively pivoted in the groove 57*a* on one of the slides 57 and its opposite lateral bead 58*b* freely but captively pivoted in the corresponding one of the grooves 56*a* on the expander rotor 56, thereby to provide a hinged connection between each of the vanes 58 and the corresponding one of the slides 57 at one side and the expander rotor 56 at the opposite side. As shown in FIG. 9 each bead 58*a*, 58*b* has a generally circular cross sectional shape while each groove 57*a* has a complementary cross sectional shape, thereby to secure a sufficient seal in the hinged connection.

The expander casing 55 is formed with a ledge-like guide ring 60, which is securely attached to the inner circumferential surface 55*a* of the casing 55 intermediate the length or height thereof. The guide ring 60 is trapezoidal in cross section as shown in FIG. 8 and comprises four quadrant components connected by four blocks 62 into the annular shape. The blocks 62 are spaced 90° apart from each other circumferentially of the guide ring 60. The slides 57 have a dovetail groove 57*b* in which the guide ring 60 slidably engages so that the slides 57 can move along the guide ring 60 in the manner to be described later, with the blocks 62 functioning as stoppers to define the range within which the slides 57 can move along the guide ring 60.

Each of the vanes 58 comprises a generally rectangular plate having a required thickness and appropriately curved in cross section.

Each of the vanes 58 has an upper edge surface 58*c* and a lower edge surface 58*d* in sliding and sealing contact with the downwardly facing upper wall surface 55*c* and the upwardly facing lower surface 55*d* of the expander casing 55, respectively, with which the upper and lower edge surfaces 56*c* and 56*d* of the expander rotor 56 as well as the upper and lower edge surfaces 57*c* and 57*d* of each of the slides 57 are in sliding and sealing contact as shown in FIG. 8.

In this third embodiment of the invention, the six regenerator units 8 are not carried by the rotor 1 for rotation therewith as in the previous two embodiments but are fitted in six separate longitudinal cavities 63 formed in the casing 54 about the rotor shaft 50 above the expander 3. The cavities 63 are spaced an equal angular distance apart from each other circumferentially about the rotor shaft 50 .

The regenerator units 8 are of the same construction as in the previous embodiments and each of the units has its low-temperature end 8*a* in communication with the corresponding one of the expander compartments 59 through a lower part 66*a* and an individual conduit 64 and its upper high-temperature end 8*b* communicated with the discharge pipe 15 or the supply pipe 14 through an upper port 66*b* and a timing valve mechanism 65.

A disk-like space 67 is formed inside the upper end portion 54*a* of the casing 54 outside the adiabatic vacuum tank 2, and the above-mentioned six upper ports 66*b* communicating with the six regenerator units 8 are open in the flat bottom surface 67*a* of the space 67.

The above-mentioned timing valve 65 comprises a flange 68 formed integral with the shaft 50 for simultaneous rotation therewith about the axis 0 and disposed inside the space 67 so that the flat under surface 68*a* of the flange 68 is in sliding contact with the bottom surface 67*a* of the space 67, with a coil spring 69 provided above the flange 68 and about the shaft 50 acting upon the flange 68 to press the same downwardly against the bottom surface 67*a* of the space 67 thereby to ensure effective sealing therebetween while enabling smooth rotation of the flange 68 on the bottom surface 67*a*.

The flange 68 is provided with a first or supply port 70*a* for connecting the supply line 14 from the compressor 21 selectively to the ports 66*b* leading to the regenerator units 8, and a second or discharge port 70*b* connecting the ports 66*b* to the discharge line 15 returning to the compressor 63.

The supply and discharge ports 70*a* and 70*b* are arcuate and formed at such particular positions in the flange 68 as to enable the operation of the refrigerator in the manner to be described later.

The expander 3 operates in the following manner. As the rotor 1 rotates, the eccentric shaft 53 with the expander rotor 56 revolves about the axis 0 in the direction X in FIG. 9, with the radius of revolution being the eccentric distance 1, so that the four compartments 59 vary in volume in such a manner that the volume of each compartment 59 varies 90° out of phase from that of the adjacent compartment. During the revolution of the expander rotor 56, the angle of each vane 58 relative to the expander rotor changes, with the beads 58*a* and 58*b* on the opposite lateral edges of the vane rotating within the corresponding complementary grooves 57*a* and 56*a* in both the corresponding slide 57 and the periphery of the rotor 56, and the displacement of each slide 57 in either direction along the guide member 60 on the inner circumferential surface 55*a* of the expander casing 55 permitting the angular change of the vane 58 accompanied by displacement of the outer edge 58*a* thereof.

Since any one of the slides 57 abuts on either of the adjacent two stoppers 60, the rotor 13 will not rotate relative to expander casing 55, so that each compartment 59 undergoes cyclic variation in shape and volume only in a certain area where the compartment contains the corresponding stopper 60.

In the third embodiment of the invention, the refrigerator operates in the following manner. Since the four expander compartments 59 operate in the same manner, the operation of only one of them will be explained by way of example.

When, upon rotation, the rotor 1 passes such an angular position that the volume of the expander compartment 59 becomes the minimum, the supply port 70*a* on the rotary valve 65 comes to communicate with that one of the ports 66*b* at the upper end of that one of the regenerator units 8 which communicates with the expander compartment 59, whereupon the compressed gas discharged from the compressor 21 through the outlet port 21*a* is conducted through the supply line 14, the above-mentioned ports 70*a* and 66*b* and the corresponding regenerator unit 8 into the compartment 59. The high-pressure gas thus introduced into the compartment drives the expander rotor 56 to revolve about the axis 0 of the rotor 1 in such a direction that the volume of the compartment 59 increases. While the expander rotor 56 revolves about the axis of the rotor 1, it rotates about its own axis 0', and the revolution of the expander rotor 56 causes the rotor 1 and the rotary valve 68 to rotate about the axis 0.

When the volume of the compartment has increased to a predetermined magnitude, communication between the ports 70*a* and 66*b* is cut off, so that no more compressed gas is supplied to the particular expander compartment 59. However, the high pressure of the compressed gas enclosed in the compartment causes the expander rotor 56 to revolve in the direction that the volume of the compartment continuously increases, so that the rotor 1 continues to rotate about its axis 0 in the same direction. While the volume of the compartment increases in the above-mentioned manner, the gas therein undergoes adiabatic expansion accompanied by a drop in the temperature.

When the rotor 1 has reached such a position that the volume of the expander compartment becomes the maximum, the discharge port 70*b* in the timing valve 65 comes to communicate with the port 66*b* now serving as an outlet port. As the rotor 1 is kept rotating by the pressure of the compressed gas being introduced into the other expander compartments now increasing in volume, the above-mentioned expander compartment now decreases in volume, so that the expanded low-temperature gas in the compartment is conducted through the corresponding regenerator unit 8, while cooling the same, to the outlet port 66*b* and the discharge port 70*b* and thence through the discharge line 15 to be returned to the compressor 21. When the rotor has reached such an angular position that the volume of the above-mentioned expander compartment has become the minimum, the communication between the outlet port 66*b* and the discharge port 70*b* of the timing valve is broken, thereby completing one cycle of operation.

By repeating the above cycle of operation a number of times, it is possible to reduce the temperature of the expander casing 55 to a very low level thereby to continuously cool a thermal load positioned adjacent the casing 55.

The torque produced by the rotation of the rotor 1 during the operation of the refrigerator may be utilized to run a suitable machine such as a generator connected to the rotor 1.

In the third embodiment of the invention the slides 57 are arranged so as to slide along the inner surface 55*a* of the expander casing 55. The arrangement may also be such that the slides to each of which one of the vanes has its one end hinged are in sliding contact with the outer circumferential surface of the expander rotor 56, with the opposite ends of the vanes being hinged to the inner circumferential surface 55*a* of the expander casing 55.

FIG. 10 shows a different expander which can be used in place of the expander shown in FIG. 9.

Each of the four vanes 58' has its one end hinged to one of the four slides 57' in a manner similar to that shown in FIG. 9, and the slides are so curved as to conform to, and be in sliding contact with, the outer circumferential surface 56*b* of the expander rotor 56 which is eccentric with respect to the axis 0 of the expander casing 54. The vanes 58' have their respective opposite ends slidably inserted in four radial slots 72 formed in the inner surface 55*a'* of the expander casing 55 and equally spaced 90° apart from each other, with springs 74 disposed in the slots 72 biasing the vanes 58' radially inwardly of the expander chamber 59' so as to bring the slides 57' into sliding contact with the expander rotor 56. The operation of the expander shown in FIG. 10 can be easily understood from the foregoing description, so that no explanation will be given.

The number of the vanes 58, 58' that can be provided is not limited to that shown in FIGS. 8 and 10.

Figure 11:
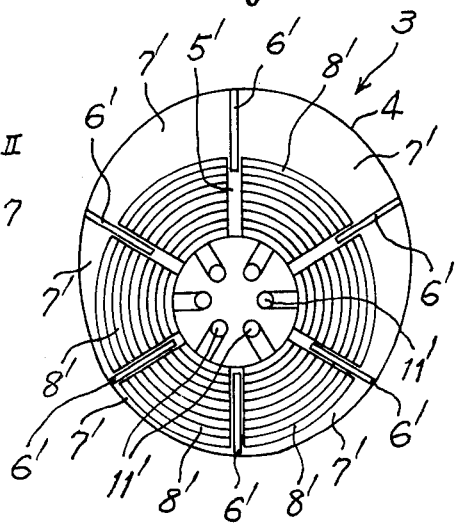
FIG. 11 is a transverse section showing a different embodiment of the regenerator incorporated into the expander.

FIG. 11 shows a different type of a regenerator which can be incorporated in the expander 3 of FIG. 1 or 5. The regenerator 8' constitutes the first portion of the rotor inside the expander casing 4 and comprises six regenerator units 8′ sector-shaped in transverse section and made of a plurality of perforated copper plates one laid upon another.

Six radial vanes 6′ similar in construction and function to those shown in FIG. 4 or 7 are mounted slidably in slots 5′ of the regenerator 8′ so as to define expander compartments 7′ of varying volume between the adjacent vanes. In other words, the regenerator also functions as the expander rotor, with the compressed gas entering the expander compartments 7′ increasing in volume through the corresponding ports 11′ and regenerator units 8′ and the expanded gas leaving the expander compartment 7′ decreasing in volume through the corresponding regenerator units and ports.

It has now become apparent that the invention provides a refrigerator which is completely free from the previously mentioned and other various disadvantages of the conventional refrigerators of the reciprocating piston type, and which is compact in size and light in weight with component members or elements of less mechanical strength and can be operated with less vibration and noise, mechanical or magnetic, and higher efficiency to attain a lower temperature in a shorter time.

What we claim is:

1. A cryogenic refrigerator comprising: a rotor in the form of an elongated generally cylindrical member rotatable about an axis; an expander comprising a casing surrounding a first portion of said rotor so as to form an expander chamber about said first rotor portion within said casing, said chamber being sealed against the adjacent space, and means associated with said first rotor portion and said casing inner wall for dividing said expander chamber into a plurality of compartments which vary in volume and relative position in said casing as said rotor rotates about said axis; a regenerator associated with a second portion of said rotor adjacent said first rotor portion and having a low-temperature and a high-temperature end and being capable of passing fluid between said ends, said low-temperature end being disposed adjacent said expander compartments for fluid communication between said regenerator and said expander compartments; and means associated with said high-temperature end of said regenerator for supplying compressed gas to, and receiving expanded gas from said expander compartments through said regenerator, whereby said compressed gas introduced successively into said expander compartments expands adiabatically as said compartments successively increase in volume.

2. The refrigerator of claim 1, wherein said means associated with said high -temperature end of said regenerator comprises a compressor and valve means for selectively connecting the high-pressure side of said compressor to said high-temperature end of said regenerator thereby to supply compressed gas to said expander compartments increasing in volume and selectively to the low-pressure side of said compressor thereby to discharge expanded gas from said expander compartments decreasing in volume.

3. The refrigerator of claim 2, wherein said valve means comprises an annular member encircling a third portion of said rotor adjacent said second rotor portion opposite to said first rotor portion, said annular member being stationery relative to said rotor and having an inner circumferential surface in sliding and sealing contact with the outer circumferential surface of said third rotor portion and being provided with a fluid supply port connected to the outlet port of said compressor and a fluid discharge port spaced circumferentially from said supply port and connected to the inlet port of said compressor, said third rotor portion being provided with a plurality of inlet-outlet ports each of which communicates with one of said regenerator units so that as said rotor rotates, said supply port is brought into communication with those of said inlet-outlet ports which communicate with those of said expander compartments which are to increase in volume while said discharge port is brought into communication with those of said inlet-outlet ports which communicate with those of said expander compartments which are to decrease in volume.

4. The refrigerator of claim 1, wherein said expander comprises a plurality of vanes mounted on said first rotor portion and spaced about the periphery thereof and extending radially as far as their outer edges are in sliding engagement with, or adjacent to, the inner circumferential surface of said expander casing so as to define between the adjacent vanes said compartments circumferentially of said first rotor portion.

5. The refrigerator of claim 4, wherein said regenerator comprises a plurality of regenerator units provided in said first rotor portion and arranged circumferentially thereof, each of said regenerator units being defined between the adjacent vanes independently from the others and in fluid communication with one of said expander compartments.

6. The refrigerator of claim 1, wherein said regenerator comprises a plurality of regenerator units provided in said second rotor portion and arranged circumferentially thereof, each of said regenerator units being independent from the others and in fluid communication with one of said expander compartments.

7. The refrigerator of claim 1, further including means for driving said rotor for rotation about said axis, and wherein said means associated with said high-temperature end of said regenerator comprises a compressor of a rotary type which comprises a second casing surrounding a third portion of said rotor so as to form a compressor chamber about said third rotor portion, said compressor chamber being sealed against the adjacent space, and means associated with said third rotor portion and said second casing inner wall for dividing said compressor chamber into a plurality of compartments which vary in volume and relative position in said compressor chamber as said rotor rotates about said axis, said expander and compressor being so correlated that fluid communication between said compressor and expander compartments is controlled in such a manner that compression of gas within said compressor compartments, transfer of compressed gas from said compressor to said expander compartments without substantial change in volume, adiabatic expansion of said compressed gas in said expander compartments, and transfer of expanded gas from said expander back to said compressor compartments without substantial change in volume are effected successively.

8. The refrigerator of claim 7, wherein said compressor comprises a plurality of vanes mounted on said third rotor portion and spaced about the periphery thereof and extending radially as far as their outer edges are in sliding engagement with, or adjacent to, the inner circumferential surface of said compressor casing so as to define between the adjacent vanes said compression compartments circumferentially of said third rotor portion.

9. The refrigerator of claim 7, wherein said expander comprises a plurality of vanes mounted on said first rotor portion and spaced about the periphery thereof and extending radially as far as their outer edges are in sliding engagement with, or adjacent to, the inner circumferential surface of said expander casing so as to define between the adjacent vanes said expansion compartments circumferentially of said first rotor portion.

10. The refrigerator of claim 7, wherein said regenerator comprises a plurality of regenerator units provided in said second rotor portion and arranged circumferentially thereof, each of said regenerator units being independent from the others and in fluid communication with one of said expander compartments.

11. The refrigerator of claim 7, wherein said regenerator comprises a plurality of regenerator units provided in said first rotor portion and arranged circumferentially thereof, each of said regenerator units being defined between the adjacent vanes independently from the others and in fluid communication with one of said expander compartments.

12. The refrigerator of claim 1, wherein said first rotor portion is eccentric with respect to, and rotatable about, the axis of said rotor, and said expander further includes an expander rotor rotatable about the eccentric axis of said first rotor portion, and said expander chamber dividing means comprises a plurality of slides in sliding contact with the inner circumferential surface of said expander casing and a plurality of vanes each having its one edge hinged to one of said slides and its opposite edge hinged to the periphery of said expander rotor, thereby to define said expander compartments between the adjacent vanes.

13. The refrigerator of claim 12, wherein said regenerator comprises a plurality of regenerator units provided in said second rotor portion for simultaneous rotation therewith, each of said regenerator units being independent from the others and in fluid communication with one of said expander compartments.

14. The refrigerator of claim 12, wherein said regenerator comprises a plurality of regenerator units provided about the periphery of said second rotor portion so as not to rotate with said rotor, each of said regenerator units being independent from the others and in fluid communication with one of said expander compartments.

15. The refrigerator of claim 12, further including means for driving said rotor for rotation about said axis, and wherein said means associated with said high-temperature end of said regenerator compresses a compressor of a rotary type which comprises a second casing surrounding a third portion of said rotor so as to form a compressor chamber about said third rotor portion, said compressor chamber being sealed against the adjacent space, and means associated with said third rotor portion and said second casing inner wall for dividing said compressor chamber into a plurality of compartments which vary in volume and relative position as said rotor rotates about said axis, said expander and compressor being so correlated that fluid communication between said compressor and expander compartments is controlled in such a manner that compression of gas within said compressor compartments, transfer of compressed gas from said compressor to said expander compartments without substantial change in volume, adiabatic expansion of said compressed gas in said expander compartments, and transfer of expanded gas from said expander back to said compressor compartments without substantial change in volume are effected successively.

16. The refrigerator of claim 1, wherein said first rotor portion is eccentric with respect to, and rotatable about, the axis of said rotor, and said expander further includes an expander rotor rotatable about the eccentric axis of said first rotor portion, and said expander chamber dividing means comprises a plurality of slides in sliding contact with the periphery of said expander rotor and a plurality of vanes each having its one edge hinged to one of said slides and its opposite edge hinged to the inner circumferential surface of said expander casing.

17. The refrigerator of claim 1, wherein said first rotor portion is eccentric with respect to, and rotatable about, the axis of said rotor, and said expander chamber dividing means further includes a plurality of slides in sliding contact with the periphery of said expander rotor and a plurality of vanes each having its one edge hinged to one of said slides and its opposite end portion slidably inserted into one of the slots formed in the inner circumferential wall of said expander casing at equally spaced apart positions.

* * * * *